US005881355A

United States Patent [19]

Sugimura et al.

[11] Patent Number: 5,881,355

[45] Date of Patent: Mar. 9, 1999

[54] FABRICATION METHOD OF CATHODE MEMBER AND ELECTRONIC TUBE EQUIPPED THEREWITH

[75] Inventors: Toshikazu Sugimura; Maki Narita; Taro Hirai; Shoichi Hata, all of Shiga, Japan

[73] Assignee: NEC Corporation, Tokyo, Japan

[21] Appl. No.: 120,373

[22] Filed: Jul. 22, 1998

[30] Foreign Application Priority Data

Jul. 23, 1997 [JP] Japan ..... 9-196618

[51] Int. Cl.[6] ..... B22F 1/00

[52] U.S. Cl. ..... 419/20; 419/31; 419/33; 419/36; 419/49; 75/246; 75/235; 313/346 R

[58] Field of Search ..... 419/20, 31, 33, 419/36, 49; 75/246, 235; 313/346 R

[56] References Cited

U.S. PATENT DOCUMENTS

| | | | |
|---|---|---|---|
| 2,682,511 | 6/1954 | Cronin . | |
| 2,957,231 | 10/1960 | Davis et al. . | |
| 3,148,056 | 9/1964 | Brodie et al. . | |
| 4,260,665 | 4/1981 | Aida | 428/633 |
| 5,407,633 | 4/1995 | Hasker et al. | 419/19 |
| 5,757,115 | 5/1998 | Navita | 313/346 R |

*Primary Examiner*—Ngoclan Mai
*Attorney, Agent, or Firm*—Whitham, Curtis & Whitham

[57] ABSTRACT

A method of fabricating a cathode member or pellet is provided, which realizes the sufficiently large increase of the electron emission capability by the current activation process and that prevents the maximum cathode current from being lowered as long as an electron emissive agent exists in the cathode member. First, (a) a nickel powder and a rare-earth-metal oxide powder are provided. (b) The nickel powder and the rare-earth-metal oxide powder are uniformly mixed together, thereby producing a first powder mixture. (c) The first powder mixture is heated in a hydrogen atmosphere, an inert atmosphere, or a vacuum atmosphere, thereby producing an intermetallic compound of nickel and the rare-earth metal in the first powder mixture. (d) The first powder mixture containing the intermetallic compound is uniformly mixed with an electron-emissive agent powder, thereby producing a second powder mixture. (e) The second powder mixture is sintered by a HIP process, thereby forming a cathode member. The intermetallic compound produced in the first powder mixture has a function to chemically decompose the electron emissive agent to thereby increase the electron emission performance of the electron emissive agent.

9 Claims, 3 Drawing Sheets

FABRICATION METHOD OF CATHODE MEMBER AND ELECTRONIC TUBE EQUIPPED THEREWITH

BACKGROUND OF THE INVENTION

1. Field of the Invention

The present invention relates to a cathode member for an electronic tube and more particularly, to a method of fabricating a cathode member of an electronic tube such as cathode-ray tubes (CRTs), traveling-wave tubes, and so on. in which the thermal activation process is completed in a shortened time and the maximum cathode current is effectively prevented from lowering, and an electronic tube equipped with the cathode member.

2. Description of the Prior Art

A conventional method of fabricating a cathode member or pellet using a hot isostatic pressing (HIP) process is disclosed in the Japanese Non-Examined Patent Publication No. 8-50849 published in 1996, which corresponds to the U.S. Pat. No. 5,757,115 issued in May 1998.

In this conventional method, first, a nickel (Ni) alloy powder containing magnesium (Mg) and silicon (Si) as reducing agents, a barium carbonate ($BaCO_3$) powder, strontium carbonate ($SrCO_3$) powder, and a calcium carbonate ($CaCO_3$) powder are well mixed together using a ball mill, thereby generating a powder mixture of these powders.

Second, the powder mixture is filled into a rubber molding die and then, the molding die is sealed. The powder mixture filled in the sealed molding die is subjected to a cold isostatic pressing (CIP) process, thereby forming a molded material.

Third, the molded material is introduced into a glass capsule, and then the capsule is sealed and held in vacuum. The capsule is then subjected to a HIP process. thereby sintering the molded material.

Fourth, the sintered, molded material is taken out of the capsule and then, it is subjected to machining processes such as cutting and polishing. Thus, a cathode pellet with a specific geometry is produced.

Finally, the cathode pellet is inserted into a cathode cap. The cathode cap with the inserted cathode pellet is inserted into the inside of a cathode sleeve and is fixed thereto by welding. Thus, a cathode assembly is fabricated.

The conventional cathode assembly including the cathode pellet, the cathode cap, and the cathode sleeve described above is mounted on a CRT in the following way.

First, the cathode assembly is fixed onto an electron gun together with a heater. Next, the electron gun with the cathode assembly and the heater is fixed to a glass valve of a CRT.

Subsequently, an electric current is supplied to the heater of the cathode assembly for the purpose of heating the cathode pellet while the inside of the glass valve is evacuated. Thus, ternary co-precipitated carbonate of Ba, Sr, and Ca, i.e., $(Ba,Sr,Ca)CO_3$, contained in the cathode pellet is chemically decomposed and changed to ternary oxide of Ba, Sr, and Ca, i.e., (Ba,Sr,Ca)O.

After the glass valve of the CRT is sealed, the heater is supplied with an electric current again to thereby heat the cathode pellet. Thus, the electron emission capability of the cathode member is increased or activated.

The activation process of increasing the electron emission capability of the cathode pellet by simply heating is termed the "thermal activation". On the other hand, the activation process of increasing the electron emission capability of the cathode pellet by applying respectively positive and negative electric potentials to the cathode and anode of the electron gun so that the activation is conducted while inducing the electron emission therefrom is termed the "current activation".

The electron emission capability of the cathode pellet is raised up to a practically high level through these two activation processes, i.e., "thermal and current activations" processes.

The cathode pellet fabricated by the above-described conventional method has the following three problems.

First, the necessary time and temperature for the thermal activation process are long and high, respectively, and consequently, the following disadvantages (i) to (iii) are caused.

(i) Since the cathode cap and the cathode sleeve are made of Nichlome alloy whose heat-resistance property is comparatively low, the cathode cap and sleeve tend to be thermally deformed in the thermal activation process.

(ii) A lot of barium (Ba) contained in the cathode pellet tends to evaporate due to high temperature in the thermal activation process, thereby shortening the lifetime of the cathode.

(iii) The evaporated barium (Ba) tends to be deposited onto a grid located near the cathode, which cases electron emission not only from the cathode pellet but also from the grid. The electron emission from the grid will generate unnecessary or undesired illumination on the screen of the CRT.

Second, the increase of the electron emission capability of the cathode pellet due to the current activation process is not sufficient.

Specifically, the electron emission capability is usually increased by the current activation process at a much lower temperature than the thermal activation process. Therefore, to avoid the above disadvantages (i) and (ii) about the thermal deformation of the cathode cap and sleeve and the Ba evaporation, it is typical that the time for the thermal activation process is set as short as possible and at the same time, the current activation process is chiefly used for increasing the electron emission capability.

In the cathode pellet fabricated by the above-described conventional method, however, the electron emission capability is scarcely increased by the current activation process. Thus, the necessary time for the thermal activation process is unable to be shortened, which makes the time for the current activation process comparatively long. Consequently, the above-described disadvantages (i) to (iii) will occur.

Third, the maximum cathode current (MIk) is unsatisfactorily prevented from lowering during practical operation.

Specifically, in the cathode pellet fabricated by the above-described conventional method, the lowering of the maximum cathode current (MIk) during practical operation is extremely small compared with the conventional oxide-coated cathode pellet, resulting in a long lifetime. However, the maximum cathode current (MIk) tends to gradually decrease during the practical operation even if free Ba remains in the cathode pellet.

An ideal cathode pellet is a pellet whose maximum cathode current (MIk) is never lowered while free Ba remains in the cathode pellet. It is not said that the above-described conventional cathode pellet is the ideal cathode pellet.

SUMMARY OF THE INVENTION

Accordingly, an object of the present invention is to provide a method of fabricating a cathode member that realizes the sufficiently large increase of the electron emission capability by the current activation process.

Another object of the present invention is to provide a method of fabricating a cathode member that shortens the necessary time for the thermal activation process.

Still another object of the present invention is to provide a method of fabricating a cathode member that prevents the above-described problems (i) to (iii) about the thermal deformation and the Ba evaporation and deposition in the thermal activation process.

A further object of the present invention is to provide a method of fabricating a cathode member that prevents the maximum cathode current from being lowered as long as an electron emissive agent exists in the cathode member.

The above objects together with others not specifically mentioned will become clear to those skilled in the art from the following description.

A method of fabricating a cathode member according to the present invention is comprised of the following steps (a) to (e).

(a) A nickel powder and a rare-earth-metal oxide powder are provided.

(b) The nickel powder and the rare-earth-metal oxide powder are uniformly mixed together, thereby producing a first powder mixture.

(c) The first powder mixture is heated in a hydrogen atmosphere, an inert atmosphere, or a vacuum atmosphere, thereby producing an intermetallic compound of nickel and the rare-earth metal in the first powder mixture.

(d) The first powder mixture containing the intermetallic compound is uniformly mixed with an electron-emissive agent powder, thereby producing a second powder mixture.

(e) The second powder mixture is sintered by a HIP process, thereby forming a cathode member.

The intermetallic compound produced in the first powder mixture has a function to chemically decompose the electron emissive agent to thereby increase the electron emission performance of the electron emissive agent.

With the method of fabricating a cathode member according to the present invention, first, the nickel powder and the rare-earth-metal oxide powder are uniformly mixed together to thereby produce the first powder mixture. Next, the first powder mixture is heated in a hydrogen atmosphere, an inert atmosphere, or a vacuum atmosphere, thereby producing the intermetallic compound of nickel and the rare-earth metal in the first powder mixture. Following this, the first powder mixture containing the intermetallic compound of nickel and the rare-earth metal is uniformly mixed with the electron-emissive agent powder, thereby producing the second powder mixture. Finally, the second powder mixture is sintered by a HIP process to thereby form the cathode member.

As described above, because the intermetallic compound produced in the first powder mixture has a function to chemically decompose the electron emissive agent to thereby increase the electron emission performance of the electron emissive agent, the electron emission capability of the cathode member is readily increased by the current activation process. Therefore, the sufficiently large increase of the electron emission capability is able to be realized by the thermal activation process. This means that the necessary time for the thermal activation process is shortened.

Also, since the necessary time for the thermal activation process is shortened, the above-described problems (i) to (iii) about the thermal deformation and the Ba evaporation and deposition in the thermal activation process are prevented from occurring.

Moreover, because of the existence of the intermetallic compound in the cathode member, the electron emission performance of the electron emissive agent is enhanced. Accordingly, even if the electron emissive agent in the cathode member gradually decreases due to evaporation so that the electron emission capability of the cathode member is lowered during the practical operation, the lowering of the electron emission capability of the cathode member is effectively compensated by the action of the intermetallic compound.

As a result, the maximum cathode current of the cathode member is prevented from being lowered as long as the electron emissive agent such as free barium (Ba) exists in the cathode member.

In a preferred embodiment of the method according to the present invention, a step of pulverizing the heated first powder mixture is additionally provided between the steps (c) and (d).

The first powder mixture tends to be coarse-grained through the heating step (c). Therefore, by pulverizing the coarse-grained first powder mixture, large particles of the electron-emissive agent are eliminated from the surface of the cathode member. Thus, there is an additional advantage that the fluctuation among individuals of the maximum cathode current is suppressed within a narrow range.

In another preferred embodiment of the method according to the present invention, a step of filtering the heated first powder mixture is additionally provided between the steps (c) and (d).

In this case, since the particle size distribution of the heated first powder mixture is narrowed within the cathode member, the mixing of the heated first powder mixture with the electron-emissive agent powder is completed more uniformly. Thus, there is an additional advantage that the fluctuation among individuals of the maximum cathode current is suppressed within a narrow range.

It is preferred that the particles of the heated first powder mixture which has a particle size greater than 20 $\mu$m are removed in the step of filtering the heated first powder mixture. In this case. the particle size of the heated first powder mixture is adjusted within the range of 5% or less with respect to the typical hole size of the grid of 300 to 400 $\mu$m. Therefore, there is an additional advantage that the uniformity of the electron emission distribution in the hole of the grid is ensured.

In still another preferred embodiment of the method according to the present invention, the nickel powder has a purity of 99.9% or greater and an average diameter of 1 to 10 $\mu$m, the electron-emissive agent powder is a co-precioictated carbonate of Ba, Sr, and Ca, i.e., (Ba,Sr,Ca)$CO_3$, and the rare-earth-metal oxide powder is a scandium oxide ($Sc_2O_3$) whose purity is 99.9% or greater and whose average diameter is 1 to 10 $\mu$m.

In this case, there is an additional advantage that the electron emission performance of the cathode member is improved due to the limitation of purity and kind of the electron-emissive agent powder and that the electron unemission region of the cathode member becomes narrow due to the limitation of particle size, resulting in improvement of focusing characteristic of a CRT.

In a further preferred embodiment of the method according to the present invention, the nickel (Ni) powder and the scandium oxide ($Sc_2O_3$) powder have a weight ratio of 100:1.7 to 100:7, and the heated first powder mixture and the electron emissive agent powder have a weight ratio of 100:36 to 100:144.

In this case, since the nickel powder and the scandium oxide ($SC_2O_3$) powder have a weight ratio of 100:1.7 to 100:7, the amount of the intermetallic compound becomes proper, thereby accelerating properly the decomposition of the electron emissive agent. Thus, the electron emission capability is further increased by the current activation process and at the same time, the maximum cathode current is prevented from lowering more effectively.

Also, since the heated first powder mixture and the electron-emissive agent powder have a weight ratio of 100:36 to 100:144, the electron emission density becomes higher and the Joule heat induced by a current flowing through the nickel powder becomes proper due to the proper amount of nickel. As a result, the cathode member is not heated excessively and the lifetime of the cathode member is elongated, while improving the mechanical strength of the cathode member.

If the electron-emissive agent powder have a weight ratio less than 100:36, the electron-emissive agent occupies an excessively narrow surface area, which leads to insufficient electron emission and the small maximum cathode current.

If the electron-emissive agent powder have a weight ratio greater than 100:144, the metallic particles becomes poor in the cathode member and as a result, the mechanical bonding strength of the sintered particles tends to be insufficient. Thus, the cathode element tends to be excessively heated due to the Joule heat, thereby shortening the lifetime of the cathode member. Additionally, because of the insufficient, mechanical bonding strength of the sintered particles, the subsequent steps such as slicing, grinding, punching, and assembly will be impossible to be carried out.

It is preferred that the heating step (c) for the first powder mixture is carried out at a temperature of 900° to 1200° C. In this case, there is an additional advantage that the nickel powder is prevented from being malted and the intermetallic compound is generated readily and sufficiently.

It is preferred that the sintering step (e) for the second powder mixture is performed at a temperature of 900° to 1200° C. and at a pressure of 500 kg/cm$^2$ or higher. In this case, there is an additional advantage that the nickel powder and the electron-emissive agent powder are prevented from being melted and consequently, the electron emission capability is not lowered while they are satisfactorily sintered.

If the cathode member fabricated by the method according to the present invention is mounted on an electron tube such as a CRT, there are the advantages that the necessary time for the thermal activation process is shortened, the previously-described problems (i) to (iii) about the thermal deformation and the Ba evaporation and deposition in the thermal activation process are prevented, and the maximum cathode current is prevented from being lowered as long as an electron emissive agent exists in the cathode member during the practical operation.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
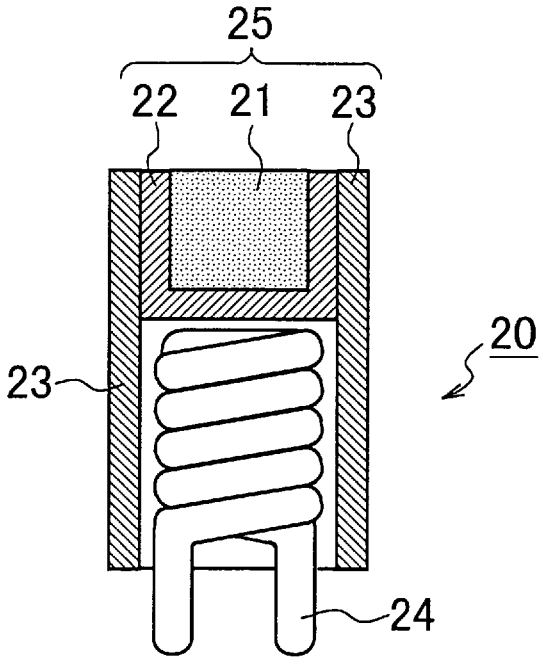
FIG. 1 is a schematic cross-sectional view of a cathode for a CRT.

Preferred embodiments of the present invention will be described in detail below while referring to the drawings attached.

As shown in FIG. 1. a cathode 20 designed for a CRT is comprised of a cylindrical cathode sleeve 23, a cathode cap 22 inserted into the top of the sleeve 23 and fixed thereto by welding, and a cathode pellet 21 inserted into the cap 22 and fixed thereto by welding.

A heater 24 is provided in the sleeve 23 to heat the cathode pellet 21.

The cathode pellet 21, the cathode cap 22, and the cathode sleeve 23 constitute a cathode assembly 25.

Figure 2:
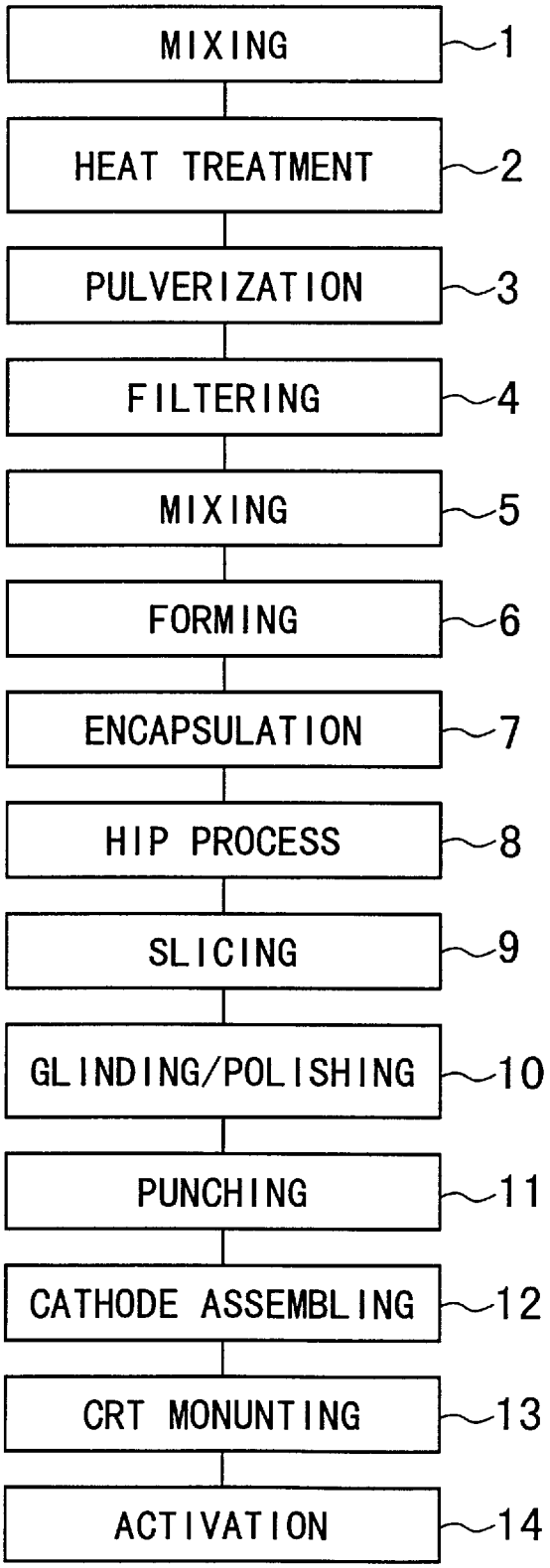
FIG. 2 is a flow chart showing the steps of a method of fabricating a cathode member according to an embodiment of the present invention, which includes the steps for making a cathode of a CRT using the cathode member.

A method of fabricating the cathode 20, which includes the cathode pellet 21 fabricated by a method according to an embodiment of the present invention, has fourteen steps as shown in FIG. 2.

First Step

In the first step 1, 100 g of a nickel (Ni) powder having a purity of 99.9% or higher and an average particle size of 3 $\mu$m and 3.5 g of a scandium oxide ($Sc_2O_3$) powder having a purity of 99.9% or higher and an average particle size of 5 $\mu$m are mixed together using a shaker mixer for 30 minutes. Thus, a Ni/$ScO_2$ powder mixture is produced.

If each of the purities of the Ni and $Sc_2O_3$ powders is lower than 99.9%, there is a possibility that the electron emission capability of the cathode pellet 21 degrades dependent upon the impurities contained in these powders. Therefore, the purities of the Ni and $Sc_2O_3$ powders need to be 99.9% or higher.

Also, to ensure the production of a nickel/scandium (Ni/Sc) intermetallic compound in a subsequent heat treatment, the Ni and $Sc_2O_3$ powders need to be uniformly mixed.

It is preferred that the average particle size of each of the Ni and $Sc_2O_3$ powders is 1 to 10 $\mu$m. If it is less than 1 $\mu$m, the particle surfaces are readily oxidized and the particles tend to form secondary particles having larger sizes, resulting in degradation of the electron emission capability of a cathode member. On the other hand, if it is greater than 10 $\mu$m, the effects caused by the areas from which the electrons are not emitted is unable to be ignored, which lowers the focusing characteristic on a phosphor screen of a CRT.

The Ni and $Sc_2O_3$ powders preferably has a weight ratio of 100:1.7 to 100:7. If the weight of the $Sc_2O_3$ powder with respect to the Ni powder is less than 1.7, the amount of the Ni/Sc intermetallic compound is insufficient and consequently, the electron emission capability due to the current activation process is not satisfactorily increased and at the same time, the maximum cathode current is not satisfactorily suppressed to lower.

On the other hand, if the weight of the $Sc_2O_3$ powder with respect to the Ni powder is greater than 7, a part of the $Sc_2O_3$ powder tends not to be contacted with the Ni powder even if these two powders are uniformly mixed, resulting in quantitative saturation of the Ni/Sc intermetallic compound. Thus, the weight ratio greater than 7 generates no further improvement in characteristics while the very expensive Sc powder raises the fabrication cost.

Second Step

In the second step 2, the Ni/$Sc_2O_3$ powder mixture produced in the first step 1 is placed in a hydrogen furnace and subjected to a heat treatment at 1100° C. for 15 minutes. Thus, the Ni and $Sc_2O_3$ powders in the $Ni/Sc_2O_3$ mixture are chemically reacted with each other to thereby generate a $Ni/Sc_2O_3$ intermetallic compound.

It is preferred that the heat-treatment temperature is set as 900° C. to 1200° C. The lower end temperature, i.e., 900° C., is required to produce a satisfactory amount of the $Ni/Sc_2O_3$ intermetallic compound. If the heat-treatment temperature is higher than 1200° C., the Ni powder tends to be partially melted so that some abnormal chemical reaction occurs, which degrades the electron emission capability of the cathode pellet 21.

Third Step

In the heat-treated $Ni/Sc_2O_3$ powder mixture, the Ni powder is partially sintered and as a result, the average particle size of the Ni powder is increased in the second step 2.

In the third step 3, therefore, the heat-treated $Ni/Sc_2O_3$ powder mixture is pulverized by using an agate mortar.

It is needless to say that any other pulverization tool than an agate mortar (for example, a ball mill or a stamping mill) may be used in this step 3. It is important that no impurity is mixed into the heat-treated $Ni/Sc_2O_3$ powder mixture during the pulverization step 3.

Fourth Step

In the fourth step 4, the pulverized and heat-treated $Ni/Sc_2O_3$ powder mixture is filtered by a 20-$\mu$m mesh screen, thereby removing the larger particles than 20 $\mu$m from this mixture. This is because the heat-treated $Ni/Sc_2O_3$ powder mixture is not always pulverized completely in the step 3.

The reason why the larger particles than 20 $\mu$m are removed is as follows.

A grid (not shown), which is fixed around the cathode 20 in an electron gun (not shown), typically has a hole of 300 $\mu$m to 400 $\mu$m. Therefore, to ensure the distribution uniformity of the emitted electrons, the powders of the heat-treated $Ni/Sc_2O_3$ powder mixture need to have particle sizes less than 5% of the grid hole of the electron gun.

Fifth Step

In the fifth step 5, 100 g of the filtered, pulverized, and heat-treated $Ni/Sc_2O_3$ powder mixture is mixed with 72 g of an electron-emissive agent powder made of ternary co-precipitated carbonate of Ba, Sr, and Ca, i.e., (Ba,Sr,Ca) $CO_3$, for 30 minutes by use of a shaker mixer. Thus, a $Ni/Sc_2O_3)/(Ba,Sr,Ca)$ $CO_3$ powder mixture is produced.

It is important that the $Ni/Sc_2O_3$ powder mixture is uniformly mixed with the $(Ba,Sr,Ca)CO_3$ powder serving as the electron-emissive agent in order to realize a uniform distribution of electron emission at the surface of the cathode 20.

Sixth Step

In the sixth step 6, the $Ni/Sc_2O_3$ /$(Ba,Sr,Ca)CO_3$ powder mixture is introduced into a cylindrical rubber molding die, and then, the molding die is sealed. Then, the molding die is applied with a high pressure of 2000 kg/cm$^2$ for a specific time period, thereby forming a cylindrical molded material of $Ni/Sc_2O_3/(Ba,Sr,Ca)CO_3$.

The molding pressure is optionally set as necessary if the molded material thus obtained has a sufficient mechanical strength against the external forces that will be applied thereto during the subsequent process steps.

Seventh Step

In the seventh step 7, the cylindrical $Ni/Sc_2O_3/(Ba,Sr,Ca)$ $CO_3$ molded material is introduced into a cylindrical capsule made of soft steel. To prevent the molded material from being contacted with the capsule and from being chemically reacted therewith, the space between the capsule and the molded material is filled with a boron nitride (BN) powder. Then, the inside of the capsule is pumped out to a vacuum atmosphere of 1 Pa.

The reason why the $Ni/Sc_2O_3/(Ba,Sr,Ca)$ $CO_3$ molded material is introduced into the capsule is to apply uniformly an external pressure to the surface of the molded material during a subsequent HIP process. Therefore, the capsule may be made of any other material (for example, a metal or glass) than soft steel if it is satisfactorily softened at a temperature of the HIP process.

The reason why the inside of the capsule is held in vacuum is to prevent oxidation of the Ni powder in the molding material during the HIP process. Therefore, the vacuum level may be higher and lower than 1 Pa.

To prevent the chemical reaction of the Ni powder, alumina ($Al_2O_3$) may be used instead of BN.

Eighth Step

Figure 3:
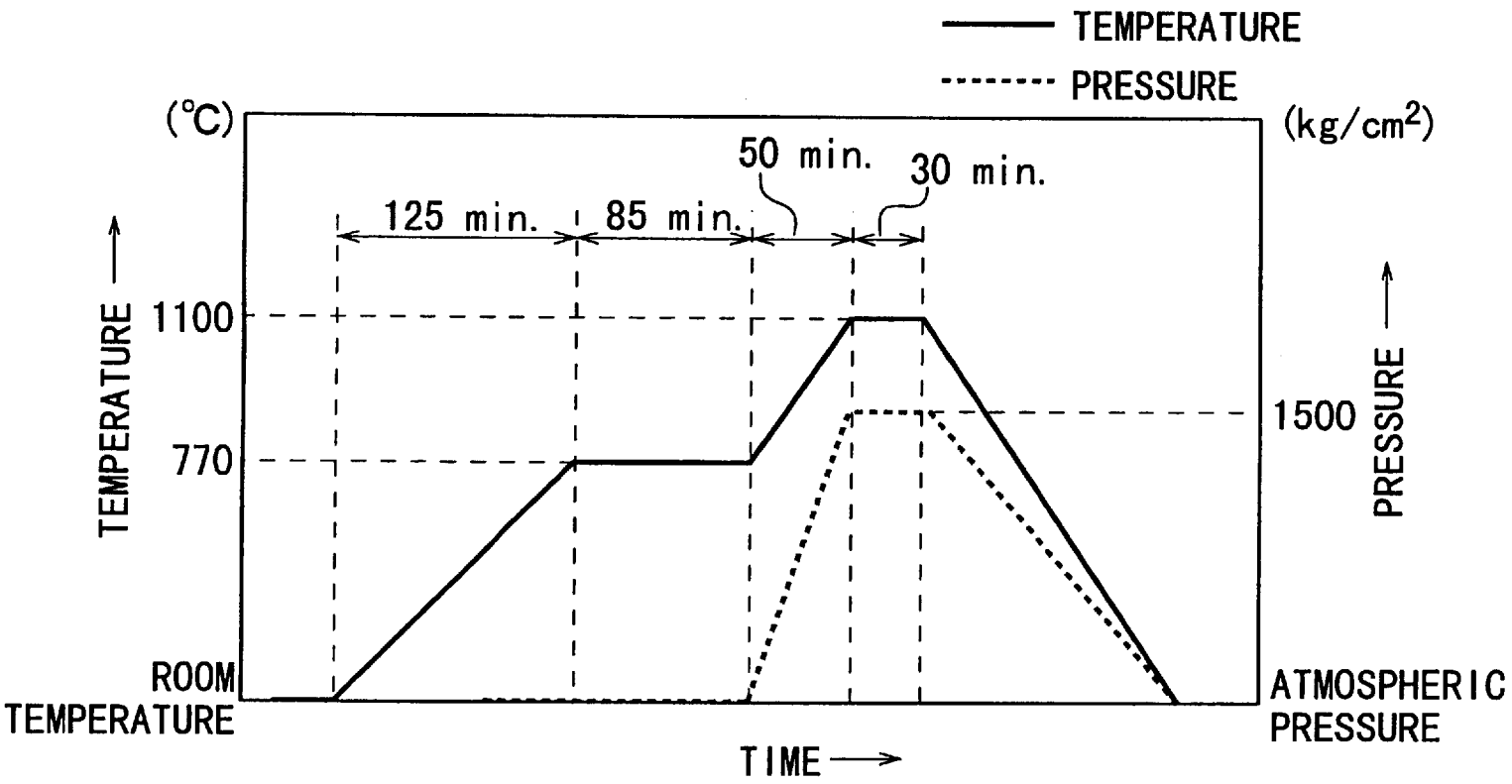
FIG. 3 is a graph showing the temperature and pressure profiles designed for the method of fabricating a cathode member according to the embodiment of the present invention.

In the eighth step 8, the $Ni/Sc_2O_3/(Ba,Sr,Ca)CO_3$ molded material sealed in the capsule is subjected to a HIP process while the temperature and pressure are varied according to the programmed profiles as shown in FIG. 3.

Specifically, first, the temperature is monotonously raised from the room temperature to 770° C. in the period of 125 minutes at a fixed temperature gradient while the applied pressure is held at the atmospheric pressure. Then, the temperature of 770° C. and the atmospheric pressure are held for 85 minutes.

The gradual heating up to 770° C. and holding this temperature is to ensure the gradual softening of the soft-steel capsule for the purpose of preventing the capsule from cracking and unequal deforming. Therefore, the temperature gradient may be optionally changed as long as the capsule is softened without any problems.

Subsequently, the temperature is monotonously raised from 770 ° C. to 1100° C. in the period of 50 minutes at a fixed temperature gradient while the applied pressure is increased from the atmospheric pressure to 1500 kg/cm$^2$ at a fixed pressure gradient. Then, the temperature of 1100° C. and the pressure of 1500 kg/cm$^2$ are held for 30 minutes. During this step, the $Ni/Sc_2O_3/(Ba,Sr,Ca)CO_3$ powder mixture or the $Ni/Sc_2O_3/(Ba,Sr,Ca)CO_3$ molded material in the capsule is sintered. Therefore, the sintering temperature is 1100° C. in this embodiment.

The sintering temperature is preferably selected within the range of 900° C. to 1200° C. if it is lower than 900° C., the $Ni/Sc_2O_3/(Ba,Sr,Ca)CO_3$ powder mixture is not satisfactorily sintered and as a result, not only subsequent grinding and polishing processes of the sintered mixture are unable to be performed but also a satisfactory electron-emission capability is unable to be realized. On the other hand, if it is higher than 1200° C., the $Ni/Sc_2O_3/(Ba,Sr,Ca)CO_3$ powder in the mixture tends to be partially melted to thereby degrade the electron emission capability drastically.

The sintering pressure is preferably selected within the range of 500 kg/cm$^2$ or higher. If it is lower than 500 kg/cm$^2$, the $Ni/Sc_2O_3/(Ba,Sr,Ca)CO_3$ powder mixture is not satisfactorily sintered. However, there is no higher limit of this pressure range, because there is no problem about unsatisfactory sintering due to an excessively high pressure.

Finally, the temperature of 1100° C. and the pressure of 1500 kg/cm$^2$ are lowered at fixed temperature and pressure gradients in the period of 150 minutes.

Ninth Step

In the ninth step 9, the sintered $Ni/Sc_2O_3/(Ba,Sr,Ca)CO_3$ powder mixture with a cylindrical shape (i.e., the cathode member) is taken out of the capsule and then, it is sliced perpendicular to its longitudinal axis, thereby producing a lot of thin circular plates or wafers with a thickness of 0.3 mm.

Tenth Step

In the tenth step 10, the circular plates or wafers of the sintered $Ni/Sc_2O_3/(Ba,Sr,Ca)CO_3$ powder mixture are grounded to have a thickness of 0.2 mm. Then, the surfaces of the wafers are mirror-polished using a diamond slurry.

Eleventh Step

In the eleventh step 11, the mirror-polished wafers are subject to punching using a set of a punch and a die, thereby producing the cathode pellets 21 each having a shape of circular plate, a diameter of 1.3 mm, and a thickness of 0.2 mm.

Twelfth Step

In the twelfth step 12, each of the cathode pellets 21 thus produced is inserted into the cathode cap 22 made of Nichlome alloy consisting of 80%-Ni and 20%-Cr. The cap 22 has a thickness of 50 $\mu$m, an inner diameter of 1.3 mm and an inner depth of 0.15 mm. Then, the cathode cap 22, which is made of Nichlome alloy consisting of 80%-Ni and 20%-Cr, is inserted into the cathode sleeve 23 with an inner diameter of 1.4 mm. Further, the cap 22 with the pellet 21 is inserted into the sleeve 23 and fixed thereto by resistance-welding, thereby forming the cathode assembly 25.

Thirteenth Step

In the thirteenth step 13, the cathode assembly 25 thus produced is mounted to an electron gun together with the heater 24. The electron gun is then incorporated into a glass valve of the CRT and the inside of the valve is evacuated and sealed. During the evacuation process, an electric current is supplied to the heater 24 to heat the cathode pellet 21, thereby chemically decomposing $(Ba,Sr,Ca)CO_3$ to a ternary oxide of (Ba, Sr, Ca)O.

Fourteenth Step

In the fourteenth step 14, the cathode pellet 21 is subjected to the thermal activation process at 1100° C. for 10 minutes and then, it is subjected to the current activation process at 950° C. for 30 minutes. Thus, the pellet 21 is sufficiently activated and as a result, the maximum cathode current (MIk) has a satisfactorily large value.

In the previously-explained conventional cathode pellet, the increase of the electron emission capability due to the thermal activation process needs to be equal to approximately 100% of the desired current value. On the other hand, the increase of the electron emission capability due to the current activation process is large in the pellet 21 according to the present invention. Therefore, it is sufficient that the increase of the electron emission capability due to the thermal activation process is equal to approximately 20% of the desired current value. The remaining 80% of the desired current value can be increased by the current activation process.

The reason why the increase of the electron emission capability due to the thermal activation process is large is as follows.

Prior to the HIP process, the Ni and $Sc_2O_3$ powders are uniformly mixed together and the resultant $Ni/Sc_2O_3$ powder mixture is subjected to the heat treatment in a hydrogen atmosphere in the second step 2. Consequently. the Ni and $Sc_2O_3$ powders are chemically reacted with one another due to this heat treatment, thereby producing a Ni/Sc intermetallic compound. The Ni/Sc intermetallic compound thus produced decomposes the barium oxide ($BaO_2$) to thereby accelerate generation of free barium (Ba).

In this embodiment, since the thermal activation process is performed in a very short time, the cathode cap 22 and the cathode sleeve 23 are not deformed. Also, since evaporation of barium (Ba) scarcely occurs during the thermal activation process, no undesired electron emission is observed from the grid (not shown).

The above-identified conditions of the thermal and current activation processes are examples and therefore, various modification are possible.

Confirmation Test

To confirm the advantages of the method according to the present invention, the inventors carried out an accelerated life test with respect to the maximum cathode current (MIk) under the following conditions.

To perform the accelerated life test, the inventive cathodes 20 were practically fabricated in the method according to the above-described embodiment and the conventional cathodes were practically fabricated in the previously described conventional method.

Next, a dc current was continuously supplied to the inventive cathodes 20 and the conventional cathodes so that the current density of these cathodes was 0.2 to 0.5 Å/cm$^2$. The maximum cathode current was measured at a time prior to start, and at several times subsequent to the start, i.e., 500 hours, 1000 hours, 1500 hours, 2000 hours, 2500 hours, and 3000 hours from the start.

As a result, in the conventional cathodes, the maximum cathode current (MIk) decreased gradually in spite of the existence of barium (Ba) in the cathode pellet and finally, the current (MIk) reached to 85% to 90% with respect to the initial current value at the time 3000 hours from the start.

On the other hand, in the inventive cathodes 20, the maximum cathode current (MIk) did not decrease at all. Thus, it was confirmed that no decrease occurred in the current (MIk) as long as barium exists in the cathode pellet 21.

As described above, because the $Ni/Sc_2O_3$ intermetallic compound produced in the $Ni/Sc_2O_3$ powder mixture has a function to chemically decompose $(Ba,Sr,Ca)CO_3$ to thereby increase the electron emission performance of the electron emissive agent of Ba, the electron emission capability of the cathode pellet 21 is readily increased by the current activation process. Therefore, the sufficiently large increase of the electron emission capability is able to realized by the thermal activation process. This means that the necessary time for the thermal activation process is shortened.

Also, since the necessary time for the thermal activation process is shortened, the previously-described problems (i) to (iii) about the thermal deformation and the Ba evaporation and deposition in the thermal activation process are prevented from occurring.

Moreover, because of the existence of the $Ni/Sc_2O_3$ intermetallic compound in the cathode pellet 21, the electron emission performance of the electron emissive agent (i.e., Ba) is enhanced. Accordingly, even if the electron emissive agent in the cathode pellet 21 gradually decreases due to evaporation so that the electron emission capability of the cathode pellet 21 is lowered during the practical operation, the lowering of the electron emission capability of the pellet 21 is effectively compensated by the action of the $Ni/Sc_2O_3$ intermetallic compound.

As a result, the maximum cathode current of the cathode pellet 21 is prevented from being lowered as long as the electron emissive agent such as free barium (Ba) exists in the cathode pelet 21.

In the above-described embodiment, the $Sc_2O_3$ powder is mixed with the Ni powder. However, any oxide of rare-earth metals such as yttrium oxide ($Y_2O_3$) may be used instead of the $Sc_2O_3$ powder.

Also, the heat treatment may be performed in an inert atmosphere such as a nitrogen or argon atmosphere or in a vacuum atmosphere. The hydrogen atmosphere is most preferred to prevent the Ni powder from being oxidized.

Although the method of fabricating a cathode member according to the present invention is applied to a CRT, it may be applied to any other electronic tubes such as traveling-wave tubes.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. A method of fabricating a cathode member, comprising the steps of:

(a) providing a nickel powder and a rare-earth-metal oxide powder;

(b) uniformly mixing said nickel powder and said rare-earth-metal oxide powder together, thereby producing a first powder mixture;

(c) heating said first powder mixture in a hydrogen atmosphere, an inert atmosphere, or a vacuum atmosphere, thereby producing an intermetallic compound of nickel and said rare-earth metal in the said first powder mixture;

(d) uniformly mixing said first powder mixture containing said intermetallic compound with an electron-emissive agent powder, thereby producing a second powder mixture; and (e) sintering said second powder mixture by a HIP process, thereby forming a cathode member;

wherein said intermetallic compound produced in said first powder mixture has a function to chemically decompose said electron emissive agent to thereby increase said electron emission performance of said electron emissive agent.

2. The method as claimed in claim 1, further comprising a step of pulverizing said heated first powder mixture is additionally provided between the steps (c) and (d).

3. The method as claimed in claim 1, further comprising a step of filtering said heated first powder mixture is additionally provided between the steps (c) and (d).

4. The method as claimed in claim 3, wherein the particles of said heated first powder mixture which has a particle size greater than 20 $\mu$m are removed in the step of filtering said heated first powder mixture.

5. The method as claimed in claim 1, wherein said nickel powder has a purity of 99.9% or greater and an average diameter of 1 to 10 $\mu$m, said electron-emissive agent powder is a co-precipitated carbonate of Ba, Sr, and Ca, and said rare-earth-metal oxide powder is a scandium oxide whose purity is 99.9% or greater and whose average diameter is 1 to 10 $\mu$m.

6. The method as claimed in claim 5, wherein said nickel powder and said scandium oxide powder have a weight ratio of 100:1.7 to 100:7, and said heated first powder mixture and said electron emissive agent powder have a weight ratio of 100:36 to 100:144.

7. The method as claimed in claim 1, wherein the heating step (c) for said first powder mixture is carried out at a temperature of 900° to 1200° C.

8. The method as claimed in claim 1, wherein the sintering step (e) for said second powder mixture is performed at a temperature of 900° to 1200 ° C. and at a pressure of 500 $kg/cm^2$ or higher.

9. An electron tube comprising said cathode member fabricated by the method as claimed in claim 1.

* * * * *